US005839689A

United States Patent [19]

Krüger et al.

[11] Patent Number: 5,839,689

[45] Date of Patent: Nov. 24, 1998

[54] AIR BOX FOR WEB CARRIER ROLLS AND HAVING A CONNECTING WALL

[75] Inventors: Jens Krüger, Heidenheim; Rudolf Beisswanger, Steinheim; Walter Kaipf, Haunsheim, all of Germany

[73] Assignee: Voith Sulzer Papiermaschinen GmbH, Heidenheim, Germany

[21] Appl. No.: 733,526

[22] Filed: Oct. 18, 1996

[30] Foreign Application Priority Data

Oct. 19, 1995 [DE] Germany ..... 195 387 972.7

[51] Int. Cl.[6] ..... B65H 18/14

[52] U.S. Cl. ..... 242/542; 242/527; 242/541.4

[58] Field of Search ..... 242/527, 541.7, 242/541.4, 542, 542.2

[56] References Cited

U.S. PATENT DOCUMENTS

| | | | |
|---|---|---|---|
| 3,346,209 | 10/1967 | Cronin | 242/542 X |
| 3,497,151 | 2/1970 | Voss et al. | 242/542 X |
| 3,515,183 | 6/1970 | Voss | 242/541.7 |
| 4,541,585 | 9/1985 | Frye . | |
| 4,565,378 | 1/1986 | Mondini et al. | 242/541.7 |
| 5,478,026 | 12/1995 | Schonmeier et al. | 242/542 X |
| 5,492,287 | 2/1996 | Raudaskoski et al. | 242/542 X |
| 5,562,261 | 10/1996 | Beisswanger et al. | 242/541.7 X |

FOREIGN PATENT DOCUMENTS

| | | | |
|---|---|---|---|
| 04996863 | 5/1992 | European Pat. Off. . | |
| 631956 | 6/1994 | European Pat. Off. . | |
| 0631955 | 1/1995 | European Pat. Off. . | |
| 0631956 | 1/1995 | European Pat. Off. . | |
| 0665178 | 8/1995 | European Pat. Off. . | |
| 665178 | 8/1995 | European Pat. Off. . | |
| 1047001 | 12/1958 | Germany | 242/541.7 |
| 9414449 | 2/1996 | Germany . | |
| 92 03366 | 3/1992 | WIPO . | |
| 9203366 | 5/1992 | WIPO . | |
| 9607608 | 3/1996 | WIPO . | |

*Primary Examiner*—Donald P. Walsh
*Assistant Examiner*—William A. Rivera
*Attorney, Agent, or Firm*—Ostrolenk, Faber, Gerb & Soffen, LLP

[57] ABSTRACT

An air box for use beneath a pair of carrier rolls or a roll winder for a web. The air box disposed beneath the carrier rolls has first and second side walls generally sealed respectively at each of the carrier rolls. The paper web passes beneath one of the carrier rolls and up between the rolls. The web may tear and the paper web then drops into the air box. A connecting wall in the air box between the side walls thereof and above the base receives the paper falling thereon rather than the paper falling into the air box. The connecting wall may be inclined to direct the falling paper toward a side wall where an opening is provided enabling the moving of the paper. The connecting wall may be perforated and the air flow into the air box is beneath the perforated wall so that the air flow through the wall cooperates in moving the falling paper along the connecting wall. As a result, the waste paper can be removed quickly and easily.

16 Claims, 2 Drawing Sheets

AIR BOX FOR WEB CARRIER ROLLS AND HAVING A CONNECTING WALL

BACKGROUND OF THE INVENTION

The invention relates to an air box used with web carrier rolls for a web winder. An example of such a combination is found in a copending U.S. application filed the same day and which corresponds to German Application 195 38 973.5.

When webs of paper are wound, the hardness of the winding is important for further processing steps that follow. Particularly for paper webs, it is critical that the winding hardness or tautness or tension on the web have a specific profile over the entire diameter of the reel. In general, the winding hardness should drop from a certain initial value radially inward to an end value radially outward. The drop should be as uniform as possible from the first layer to the last layer. It should have a certain gradient, i.e., it should not be too steep or too shallow. The profile of the winding hardness should never change abruptly, e.g., drop suddenly.

The desired winding hardness profile is only achieved if certain measures are taken. If such measures are not taken, in contrast, then as the diameter of the reel increases, the line pressure between the reel and the carrier roll or the carrier rolls becomes increasingly greater, as does also the winding hardness.

In order to avoid this problem, known winding apparatus use compressed air, which enters through a compressed air connection into a pressure tight chamber beneath the paper reel. In this arrangement, the air volume or air pressure can be controlled according to the increasing weight of the reel. It is also possible to divide the pressure tight chamber into individual chambers over its length, i.e. over the web width, and to provide each individual chamber with a pressure connection. This also makes it possible to compensate for sagging of the reel.

EP 91914763 discloses a winding apparatus which has an air box which can be removed from its operating position by a pivoting or translatory movement. This apparatus has a disadvantage. A paper web occasionally tears in a carrier roll winding machine. That paper web drops into the above described type of air box. This waste paper has to be removed as quickly as possible. For this purpose, according to EP 91914763, the entire air box has to be pivoted.

However, the air box has a considerable overall volume and a correspondingly high weight. The air box extends over the entire length of the winding bed, which may measure several meters, and it weighs several hundred kilograms. To move the box requires a high outlay movement mechanism with a corresponding drive. Moreover, the translatory or pivoting movement of the air box takes up a quite considerable amount of space, which is often not available.

SUMMARY OF THE INVENTION

The object of the invention is to provide an air box for a pair of web carrier rolls, which box may remain stationary when it is desired to remove residual paper after the paper web tears. Another object is to avoid a high outlay movement mechanism with associated drive for this purpose and to also require a smaller amount of space for the whole machine.

The invention concerns an air box for use beneath a pair of carrier rolls or a roll winder for a web. The air box disposed beneath the carrier rolls has first and second side walls generally sealed respectively at each of the carrier rolls. The paper web passing beneath one of the carrier rolls and up between the rolls may tear and the torn paper web drops into the air box through its open top. A connecting wall located in the air box and extending between the first and second side walls receives the paper thereon rather than the paper falling into the air box. The wall may be inclined to direct the falling paper toward a side wall where an opening is provided enabling removal of the paper. The connecting wall may be perforated. The air may flow into the air box from beneath the perforated wall so that the air flow through the wall cooperates in moving the falling paper along the wall. As a result, the waste paper can be removed from the box quickly and easily.

The air box of the invention serves two purposes. It provides the air flow which sets the hardness of the web winding and it also enables the torn web that has fallen into the air box to be easily removed.

Other features and advantages of the present invention will become apparent from the following description of an embodiment of the invention which refers to the accompanying drawings.

DETAILED DESCRIPTION OF PREFERRED EMBODIMENTS

Figure 1:
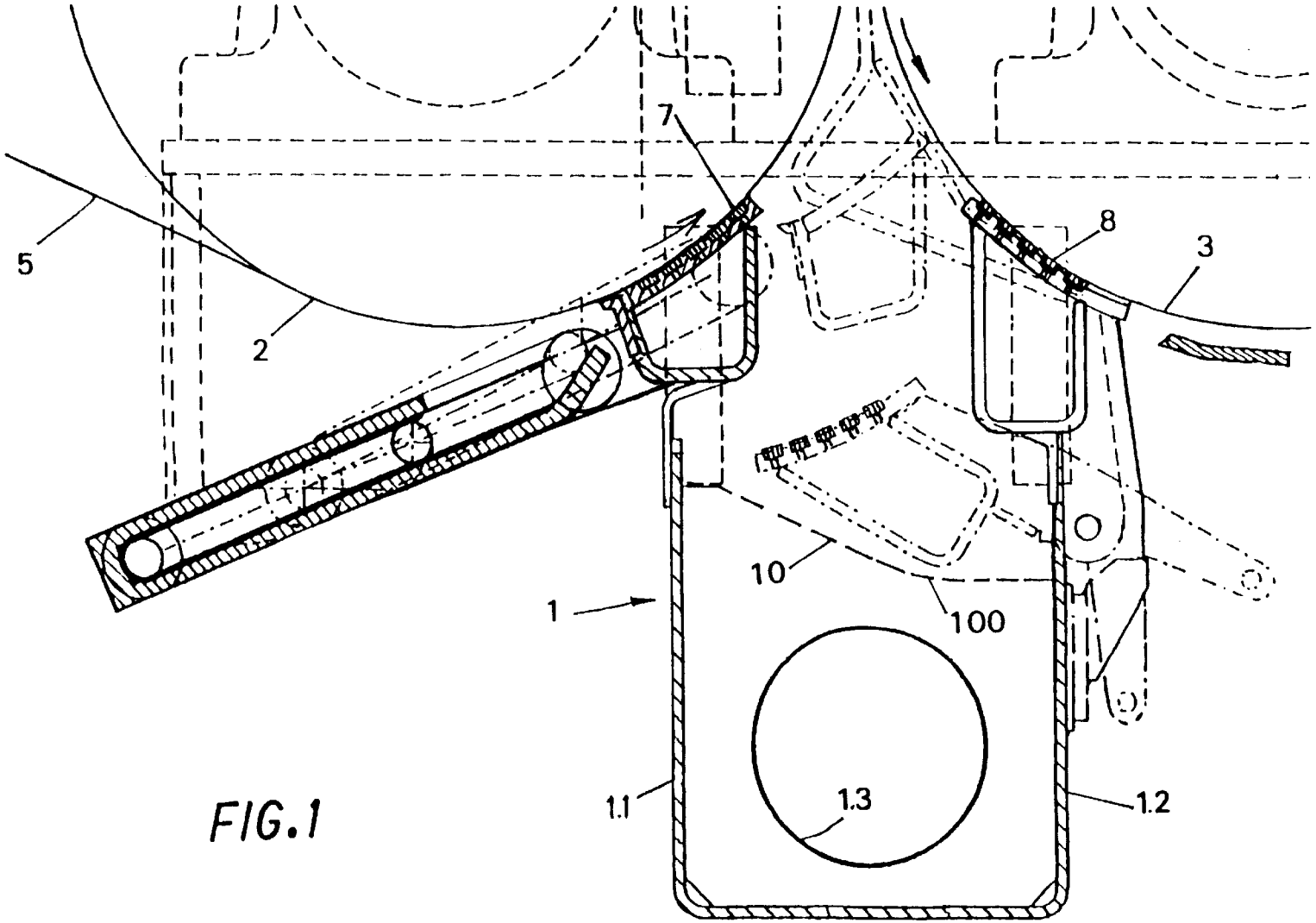
FIG. 1 shows a transverse cross section of an air box 1 of a winding apparatus and, in a preferred embodiment, the air box may be of a fixed design.

FIG. 1 shows an embodiment of an air box according to the invention. Two rotatable web reel carrier rolls 2, 3 are arranged above the air box 1. The rolls 2, 3 together form a winding bed for receiving a paper reel (not shown) disposed above them. The paper reel is made by winding up a paper web 5 that is advanced from the bottom left in FIG. 1 and that wraps around the carrier roll 2 to pass up between the rolls 2, 3. The paper reel may be conventionally loaded in a controllable manner by a loading or rider roll applied to the reel (not shown), in order to influence the bearing pressure of the rolls 2, 3 against the winding reel.

The air box 1 has first and second spaced apart side walls 1.1 and 1.2, each respectively below and having an upper end extending toward one of the rolls 2, 3. The walls have respective sealing elements 7, 8 at their upper ends. The rolls and their sealing elements define the opposite ends of the air box. Each sealing element 7, 8 produces a seal between the respective wall of the air box 1 and the respective carrier roll 2 or 3 above that wall. The box has a base or bottom that joins the side walls.

A connecting element 10 according to the invention, in the form of a wall, is arranged in the air box, is fastened between its opposite stationary side walls 1.1 and 1.2 and is spaced above the base of the air box.

If the paper web is torn while it is being wound on the reel, then the advancing paper web drops into the air box. This waste paper should be removed as quickly as possible. The connecting wall 10 intercepts the waste paper. Waste paper on the connecting wall 10 can be removed more easily and quickly, for example, through one of the two lateral end sides of the air box 1 than if the paper were lying on the base of the air box 1. The removal of the waste paper may even be automated, for example, by means of a scraper or a circulating conveying belt.

Furthermore, the connecting wall 10 has additional functions. It reinforces the structure of the air box 1. The compressed air is fed to the air box 1 through one or both lateral end sides, e.g. through feed line 1.3, and beneath the wall 10. The wall 10 uniformly distributes the air over the cross section of the air box 1. The connecting wall 10 may have perforations 100 for distributing the air in the box above the wall. In this case, when the air flow into the air box is preferably from below the wall 10, the air moves up through the perforations 100 to raise the waste paper so it can move along the wall for easier removal from the box.

In a further embodiment, the perforations 100 of the connecting wall may be distributed in a specific pattern. For example, the size or number of the bores in the connecting wall may decrease toward the lateral end regions reducing the air flow toward the edges of the web. This could be expedient because it is precisely in the central region that the paper reel sags to a particularly pronounced extent.

Finally, the connecting wall 10 could also have a shutter enabling the throughput of the individual compressed air streams which pass through the bores of the connecting wall 10 to be changed as needed.

Figure 2:
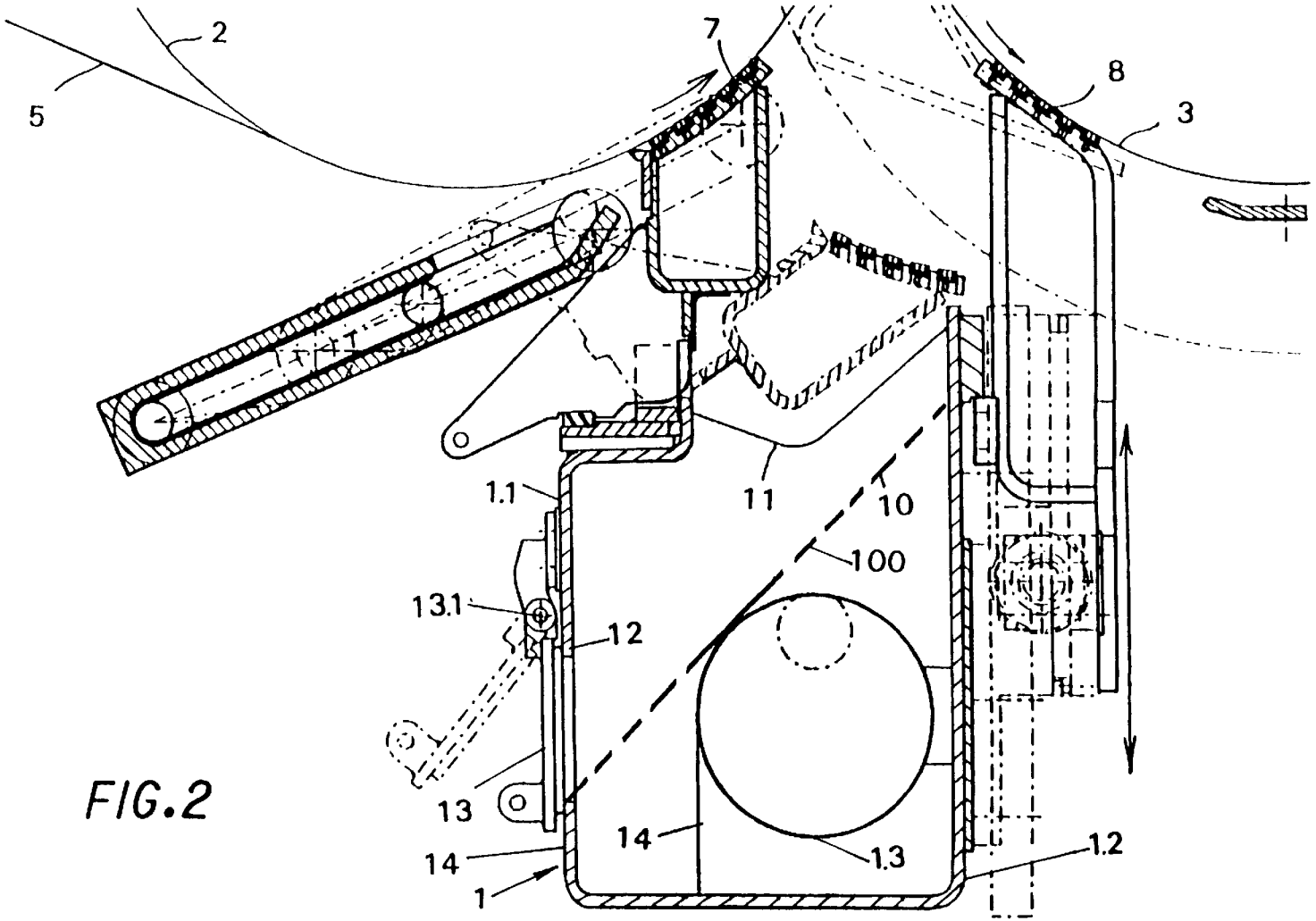
FIG. 2 shows an alternate embodiment.

A further embodiment of the invention is illustrated in FIG. 2. The air box 1 has its two side walls 1.1 and 1.2 with their respective seals 7, 8. The air box 1 in FIG. 2 has, in addition to the connecting wall 10, reinforcing ribs 11 which connect the side walls 1.1 and 1.2 of the air box. They are shaped and positioned to not interfere with the paper falling to the wall 10. Metal plates 14 are fitted around the air feed line 1.3 of the air box. They fasten the air feed line 1.3 in the air box.

Just like the air box embodiment in FIG. 1, the connecting wall 10, which may be perforated, likewise intercepts the residual paper that falls into the box when the paper web is torn.

Further, the connecting wall 10 is inclined between the side walls 1.1 and 1.2, in order that the residual paper can slide downward along the wall 10 in the air box toward the side wall 1.1.

In FIG. 2, the air box 1 has an opening 12 in the side wall 1.1 above the wall 10 there. A closing device is arranged in front of the opening 12, for example a flap 13 as illustrated, which is pivotally mounted on the main part of the air box 1 at the pivot axis 13.1. The inclined connecting wall 10 is fastened in the bottom section 1.4 of the side wall 1.1 and terminates directly in front of the opening.

If the paper web 5 tears, the residual paper is intercepted by the connecting wall 10, slides toward the opening 12, on account of the inclination of the connecting wall 10, and accumulates at the opening 12. It is possible to remove the residual paper easily after pivoting open the flap 13 which is arranged in front of the opening 12.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An air box for a carrier-roll winding machine having first and second neighboring carrier rolls which are adapted to support a reel thereon on which a web is wound, the carrier rolls being positioned near each other, the air box comprising:

respective first and second side walls for being disposed beneath the first and second carrier rolls, one of the side walls being for positioning so as to be generally sealed at each of the carrier rolls, and the side walls being spaced apart to define an open area in the air box;

a base of the air box joining the side walls and having a length;

a connection for feeding air into the air box; and a connecting wall in the air box above the base, extending between the side walls within the open area in the air box, substantially along the length of the base, and positioned for receiving thereon paper which falls into the air box, as when the web tears.

2. The air box of claim 1, wherein the side walls are fixed in position with respect to each other.

3. The air box of claim 1, wherein the connecting wall is fastened to and between each of the side walls.

4. The air box of claim 3, further comprising reinforcing ribs extending between the side walls in addition to the connecting wall for reinforcing the air box.

5. The air box of claim 1, further comprising an opening in one of the side walls at the connecting wall providing access into the air box.

6. The air box of claim 5, further comprising a device for selectively opening and closing the opening in the one side wall.

7. The air box of claim 6, wherein the device comprises a pivotable flap supported to the one side wall and pivotable between the open and closed positions.

8. The air box of claim 5, wherein the connecting wall is generally inclined between the side walls downward toward the opening, so that residual paper on the connecting wall may slide along the inclined connecting wall.

9. The air box of claim 8, wherein the connection for feeding air into the air box is disposed beneath the connecting wall, whereby air entering the air box may pass the connecting wall.

10. The air box of claim 9, wherein the incline of the connecting wall is so directed and the opening in the side wall is so placed that paper on the connecting wall may slide toward the opening in the side wall.

11. The air box of claim 1, wherein the connecting wall is inclined toward one of the side walls such that paper on the connecting wall may slide along the inclined connecting wall.

12. The air box of claim 11, further comprising an opening in one of the side walls at the connecting wall providing access into the air box, and wherein the incline is so directed and the opening in the one side wall is so placed that the paper slides toward the opening in the one side wall.

13. The air box of claim 12, further comprising perforations defined in the connecting wall through which air may pass.

14. The air box of claim 13, wherein the connection for feeding air into the air box is disposed beneath the connecting wall, whereby air entering the air box may pass through the perforations of the connecting wall.

15. The air box of claim 1, further comprising perforations defined in the connecting wall through which air may pass.

16. The air box of claim 15, wherein the connection for feeding air into the air box is disposed beneath the connecting wall, whereby air entering the air box may pass through the perforations of the connecting wall.

* * * * *